US005161286A

United States Patent [19]

Herrington, Jr. et al.

[11] Patent Number: 5,161,286

[45] Date of Patent: Nov. 10, 1992

[54] END CLAMP STOPS FOR PLASTIC RECLOSABLE FASTENER

[75] Inventors: F. John Herrington, Jr., Holcomb; Eric A. St. Phillips, Fairport, both of N.Y.

[73] Assignee: Mobil Oil Corporation, Fairfax, Va.

[21] Appl. No.: 673,712

[22] Filed: Mar. 22, 1991

[51] Int. Cl.[5] ..... A44B 19/36

[52] U.S. Cl. ..... 24/387; 24/400; 24/435

[58] Field of Search ..... 24/399, 400, 370, 418, 24/435, 389, 387, 388; 383/64

[56] References Cited

U.S. PATENT DOCUMENTS

| | | | |
|---|---|---|---|
| 3,259,951 | 7/1964 | Zimmerman . | |
| 3,790,992 | 2/1974 | Herz . | |
| 3,988,239 | 1/1970 | Heimberger | 24/435 X |
| 4,520,534 | 6/1985 | Netto | 24/399 |
| 4,756,061 | 7/1988 | Jones et al. | 24/435 X |
| 4,825,514 | 5/1989 | Alceno | 24/389 |
| 4,890,935 | 1/1990 | Ausuit et al. | 24/399 X |

FOREIGN PATENT DOCUMENTS

| | | | |
|---|---|---|---|
| 560103 | 3/1949 | United Kingdom | 24/435 |
| 812842 | 5/1959 | United Kingdom | 24/389 |

*Primary Examiner*—James R. Brittain

*Attorney, Agent, or Firm*—Alexander J. McKillop; Charles J. Speciale

[57] ABSTRACT

A thermoplastic bag having a zipper that is operated by a slider is provided with end termination clips that firmly holds the two zipper elements together to resist stresses applied by normal use and also stops the slider from going off past the end of the zipper. The end termination clip is formed by clamps consisting of plastic members between which are sandwiched the zipper and fin and wherein the clamping members are held together by a plastic rivet through the film. In one embodiment the end termination clips include hook structure for engaging a detent in the slider which provides the bag user with the feel of a definite parking position for the slider when the bag is closed.

4 Claims, 5 Drawing Sheets

END CLAMP STOPS FOR PLASTIC RECLOSABLE FASTENER

BACKGROUND OF THE INVENTION

The present invention relates to improvements in plastic reclosable fasteners with sliders for opening and closing the reclosable fasteners on plastic bags and the like and particularly to the provision of end clamps on the reclosable fastener to seal the ends of the fastener and to provide stops to retain the slider on the fastener.

Plastic reclosable fasteners or zippers with sliders are well known in the art. The plastic zippers have profiles and include a pair of male and female fastener elements in the form of reclosable interlocking rib and groove elements with a slider for opening and closing the rib and groove elements. In the manufacture of thermoplastic film bags, a pair of these male and female fasteners elements extend along the mouth of the bags and these male and female elements are adapted to be secured in any suitable manner to the flexible walls of the thermoplastic film bags. These elements may be integral marginal portions of such walls or they may be extruded separately and thereafter attached to the walls along the mouth of the bag. Various arrangements have been utilized heretofore to maintain the slider on the zipper. In one of the more conventional arrangements the slider includes a separator finger that extends down between the integral locking rib and groove elements as the slider is moved from one edge of the bag to the other edge of the bag. When the bag is opened, the only thing to stop the slider was the side seam at the edge of the bag when the slider finger comes into contact with it. This prior art is described in U.S. Pat. No. 3,790,992. In that patent there is disclosed an improvement wherein the heat seals that join the rib and groove elements are wider at one edge then the second edge of the bag and the wider seal being of width at least equal to the length of the slider from its closing end to the finger so that the slider will remain fully on the bag at the end of its travel when opening the bag. The patent points out that these sealed areas provide stops for the slider. Another arrangement for providing stops at the end of the zipper is disclosed in U.S. Pat. No. 3,259,951. In that patent the opposite ends of the interlocking or mating strips are permanently joined or sealed to each other at the ends with stop members sealed between the opposite ends of these members to stop the longitudinal movement of the slider therealong.

It would be desirable to provide a plastic bag having a zipper that is operated by slider wherein the zipper is terminated by means that firmly holds the two zipper elements together at the ends to resist stresses applied by normal use and to also stop the slider from moving off past the ends of the zipper.

RELATED APPLICATIONS

A plastic reclosable fastener with self-locking slider is disclosed in the related application of F. J. Herrington and Eric A. St. Phillips entitled "Plastic Reclosable Fastener with Self-Locking Slider" Ser. No. 673,707 filed Mar. 22, 1991.

A plastic reclosable fastener with protruding end stops to retain the slider on the fastener is disclosed in the related application of F. J. Herrington and Eric A. St. Phillips entitled "Protruding End Stops for Plastic Reclosable Fastener", Ser. No. 673,706 filed Mar. 22, 1991. The disclosures in these related applications are incorporated herein by reference thereto. Both of these applications are assigned to the same assignee as the present application.

SUMMARY OF THE INVENTION

It is an object of the present invention to provide a plastic reclosable fastener with improved end stop means for retaining the slider on the fastener.

The present invention relates to the manufacture of thermoplastic bags and the like having a reclosable fastener extending along the mouth of the bag and a slider straddling the fastener for opening and closing the fastener. The fastener comprises a pair of flexible plastic strips secured to the facing side walls of the bag and has reclosable interlocking male and female profile elements on the respective strips. The improvement comprises end clamp means located at the opposite ends of the reclosable fastener, each of the end clamp means comprising a pair of clamp members positioned on opposite sides of the bag for clamping the pair of strips and the facing side walls of the bag therebetween. There is further provided means for clamping each of the pair of clamp members together to provide a seal at the ends of the reclosable fastener, the end clamp means being engageable with the slider to prevent the slider from moving past the ends of the reclosable fastener.

In accordance with one aspect of the invention the means for clamping each of the pair of clamp members together comprises a rigid member extending through the ends of the pairs of strips and the facing side walls of the bag and secured to the pair of clamp members. In accordance with a further aspect of the invention the rigid member comprises a rivet secured at its opposite ends to the pair of clamp members. In accordance with another aspect of the invention the pair of clamp members of each of the end clamp means are connected together by a flexible strap with extends over the top of the pair of strips and the facing side walls of the bag.

In accordance with another aspect of the invention one of the clamp members of each pair includes a rivet member integral therewith and the other clamp member of each pair includes an opening therethrough adapted to receive the end of the rivet member.

In accordance with another aspect of the invention one end of the reclosable fastener forms the closed end thereof when the slider is at that end and the end clamp means located at the closed end of the reclosable fastener includes detent structure cooperable with structure on the slider when the slider is at the closed end for providing a resistance to movement of the slider during initial opening of the reclosable fastener. Further in connection with this aspect of the invention the detent structure comprises hook means on one of the clamps of the end clamp means for cooperating with recess structure on the slider.

The present invention also relates to the method of manufacturing a plurality of thermoplastic bags from a pair of superimposed thermoplastic sheets having a top edge with a reclosable fastener extending therealong including sliders for each bag formed from the sheets straddling the fastener for opening and closing the fastener. The fastener comprises a pair of flexible plastic strips secured to the facing sidewalls of the bag and having reclosable interlocking male and female profile elements on the respective strips. The method comprises the steps of clamping and sealing together the pair of flexible plastic strips and the facing sidewalls of the bag sandwiched therebetween on adjacent bags to form top pre-seal areas on adjacent bags and to reduce the material thickness of the pair of flexible plastic strips and the facing sidewalls of the bag sandwiched therebetween at the pre-seal areas. The method also includes the step of wrapping clamping strap means with the top edges of the pair of strips at the pre-seal areas with the opposite ends of the clamping strap means engaging the opposite faces of the pre-seal areas. The method further includes the step of inserting a rigid member through the pre-seal areas and through at least one end of the clamping strap means and clamping and sealing the opposite ends of the clamping strap means to the opposite ends of the rigid member to produce a leakproof end termination on adjacent bags. This method also includes the step of thereafter forming a side seal across the sheets between the bags and severing the bags from each other at the pre-seal areas.

DESCRIPTION OF THE PREFERRED EMBODIMENT

Figure 1:
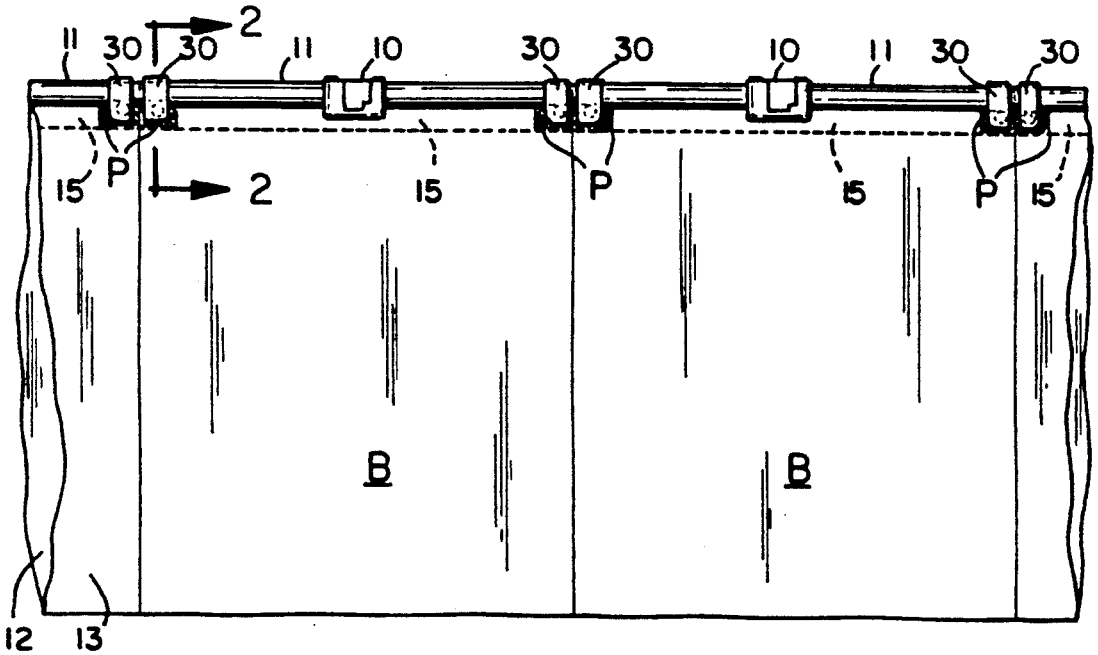
FIG. 1 is an elevational view of a series of thermoplastic bags manufactured in accordance with the present invention.
Figure 2:
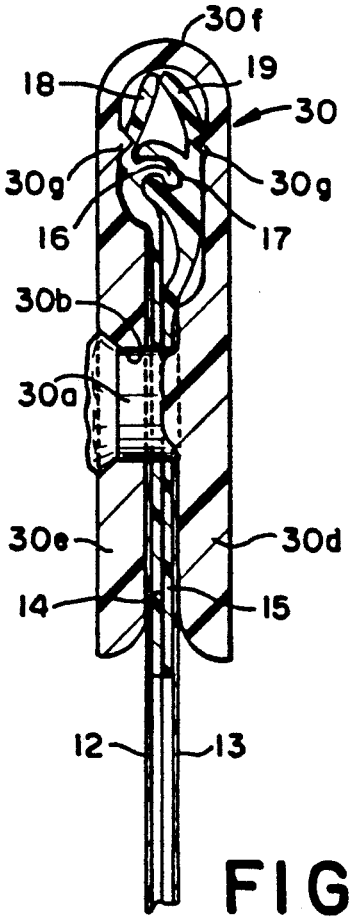
FIG. 2 is a sectional view taken along the lines 2—2 in FIG. 1 shown on enlarged scale.

Referring to FIG. 1, there is illustrated a series of thermoplastic bags B each having a plastic slider 10 and a profiled plastic reclosable fastener or zipper 11 with end termination clips or clamps 30 embodying the present invention. The slider 10 and zipper 11 are particularly suited for thermoplastic bags and the like and the slider 10 has been illustrated in FIGS. 1 and 6 assembled on the zipper 11 at the top edge or mouth of a thermoplastic bag B. The bag B may be made from any suitable thermoplastic film such for example as polyethylene or polypropylene or equivalent material. The bag B is formed by a pair of flexible plastic sheets 12 and 13 joined at the bottom and having a top edge, with a pair of flexible plastic strips 14 and 15 having separable plastic means extending along the length thereof comprising reclosable interlocking male and female profile elements in the form of rib and groove elements 16 and 17 on the respective strips to form the zipper 11. The strips 14 and 15 may be extruded separately and attached to the respective sides of the bag mouth or the strips 14 and 15 may be extruded integral with the sides of the bag mouth. The strips 14 and 15 include profiled tracks 18 and 19 extending along the length thereof parallel to the rib and groove elements 16 and 17 and the rib and groove elements 16, 17 preferably have complementary cross-sectional shapes such that they are closed by pressing the bottom of the elements together first and then rolling the element to a closed position toward the top thereof. The cross-sectional shapes of the interlocking male and female elements having the rib and groove profiles 16 and 17 are the subject of the invention claimed in the related application of F. J. Herrington entitled "Rolling Action Zipper Profile and Slider Therefor" Ser. No. 490,110, filed Mar. 7, 1990.

Figure 5:
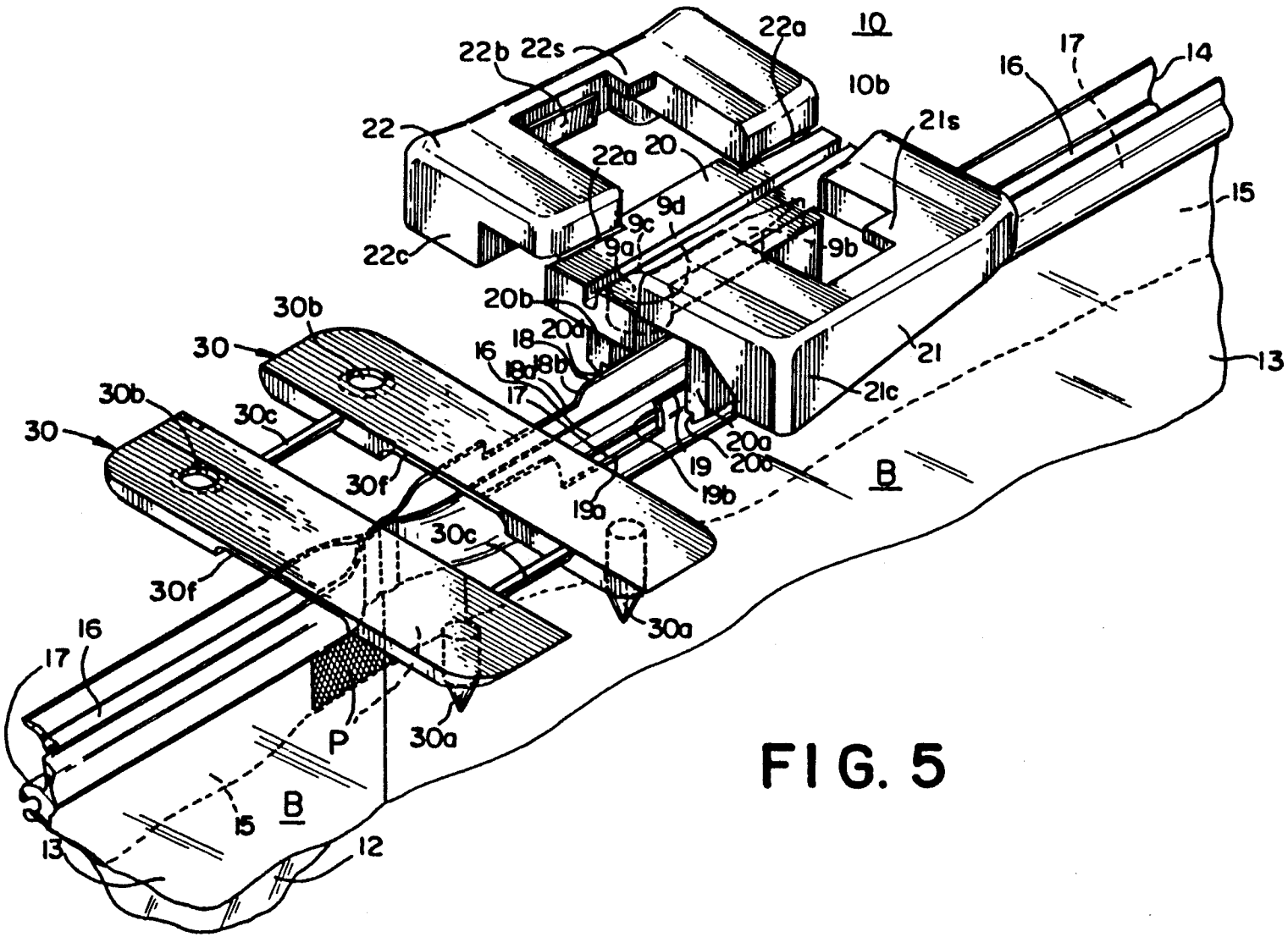
FIG. 5 is a perspective view on enlarged scale showing one of the end stops and the slider preparatory to assembly on the bag.
Figure 6:
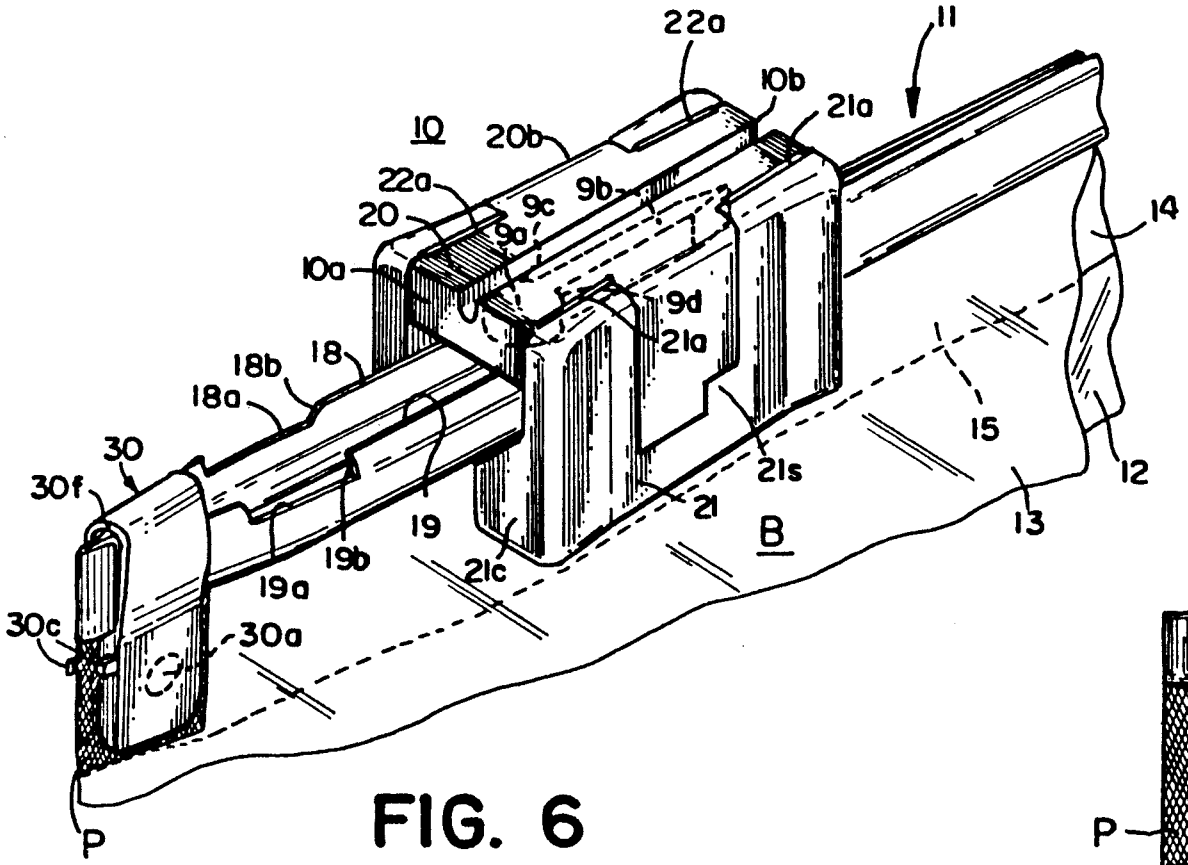
FIG. 6 a perspective view similar to FIG. 5 showing the end clamp and slider assembled on the bag.

As may be seen in FIGS. 1, 5 and 6 the slider 10 straddles the zipper 11 at the top of the bag B and is adapted for opening or closing the reclosable fastener elements 16 and 17 of the zipper 11. The slider 10 is formed from a single piece of molded plastic comprising separator finger 9, FIGS. 5 and 6, and interlocking complementary structure moving along the zipper 11. The separator finger 9 cooperates with the zipper 11 in such a manner as to provide a self-locking feature for the slider and a leakproof bag as hereinafter to be described in more detail. The slider 10 and the end clamps 30 may be molded from any suitable plastic such for example as nylon, polypropylene, polystyrene, Delrin or ABS.

Referring again to FIG. 1 it will be seen that the opposite ends of the zipper 11 are provided with end clamps 30, 30. Each of the end clamps 30 is identical and are best shown in FIGS. 2–6 Each end clamp 30 comprises a strap member which wraps over the top of the zipper 11. One end of the strap is provided with a rivet like member **30*a* which is sharp enough to penetrate through the bag material and into a cooperating opening 30*b* at the other end of the clamp 30. The mating opening 30*b* fits sufficiently tightly on the pin 30*a* that the clamp 30 can be snapped over the end of the zipper 11 and held together by the fit of the pin 30*a* in the hole 30*b*. In the first operation, the clamp 30 is snapped over the profile, then in a second operation a head is formed on the end of the pin 30*a* by pressure, heat or ultrasonic melting so as to form a head which is locked into the opening 30*b*. Thus it will be seen that the two elements of the clamp 30 are held to each other and not to the bag itself, and the clamp 30 performs as a structural member independent of the film. The end clamps 30 perform the dual function of stops for the ends of the zipper 11 to prevent the slider 10 from going off past the end of the zipper 11 and they also hold the two zipper elements together to resist stresses applied to the zipper elements through normal use of the bag. The stops 30 also provide a convenient finger grip for the user when moving the slider 10** in an opening or closing direction.

Figure 3:
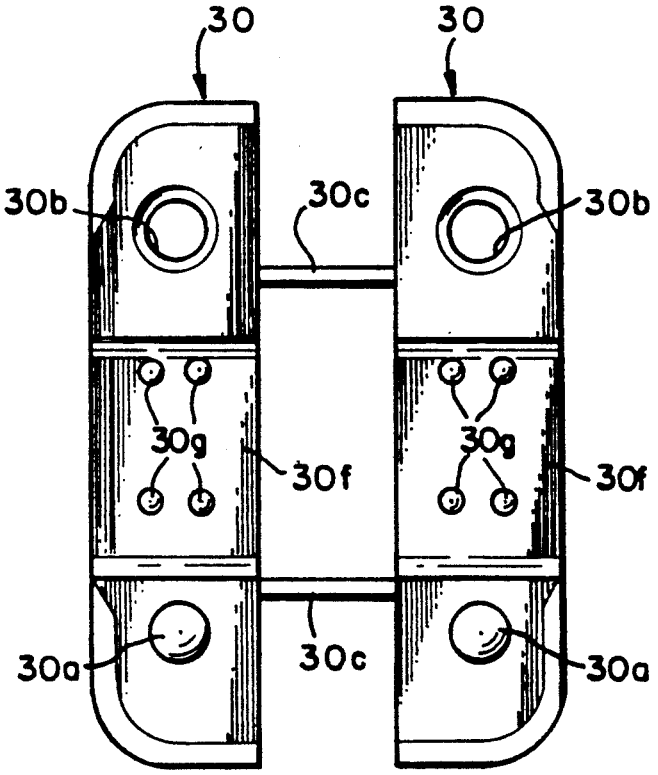
FIG. 3 is a plan view of a pair of the end clamp stops of FIG. 1 shown on enlarged scale.
Figure 4:
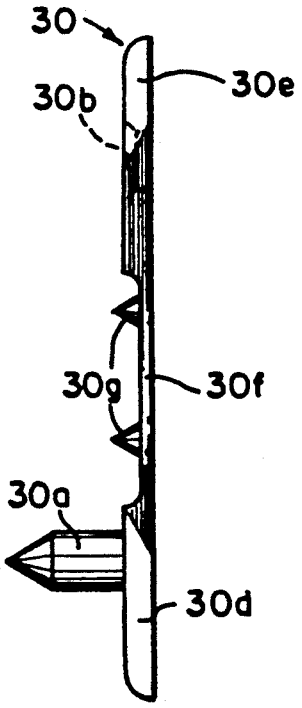
FIG. 4 is an end view of one of the end stops shown in FIG. 3.

Referring to FIG. 3 it will be seen that the end clamp members 30 are preferably molded in pairs with one of the end clamps 30 being adapted to be attached to the left hand end of a bag and the other end clamp 30 of the pair being adapted to be attached to the right hand end of an adjacent bag as shown in FIG. 1. As may be seen in FIG. 3 the end clamps 30 are maintained in pairs during the manufacture of the bags by reason of the thin interconnecting strips **30*c* which maintain the stops 30 in predetermined spaced relation. As may be seen in FIGS. 3 and 4 each of the end clamps 30 includes a pad 30*d* from which the rivet like member 30*a* extends and a similar pad 30*e* through which the opening 30*b* extends. The diameter of the rivet 30*a* and the diameter of the hole 30*b* are the same so as to provide a press fit when the rivet 30***a* is inserted through the opening 30*b*. The pads 30*d* and 30*e* are interconnected by a relatively thin flexible strap section 30*f*. The pads 30*d* and 30*e* which are held together by the rivet 30*a* act as a pair of clamps on the opposite sides of the zipper 11 with the flexible strap portion 30*f* wrapped over the top of the zipper 11 as shown in FIG. 6. The flexible strap portion 30*f* has been illustrated in FIGS. 3 and 4 with pointed projections 30*g* which are adapted to engage the top of the zipper 11 and aid in maintaining the end termination clamps 30 in position on the zipper 11. It will also be noted in FIGS. 2–4 that the pad or clamp member 30*e* is longer in the longitudinal direction than the cooperating clamp member 30*d*. The purpose of this is to accommodate the irregular shape of the zipper 11 when it is in sealed relation at the ends of the bag.

An ultrasonic welder or heat bar may be used to produce a thinning of the track profiles of the zipper 11 prior to the side seal operation. To aid in making the bags leakproof, a pre-seal is formed on the plastic strips 14 and 15 at the side seal locations to reduce the material thickness and prepare for a leakproof end termination. This is accomplished by clamping and sealing together the pair of flexible plastic strips 14 and 15 and the facing sidewalls of the bag sandwiched therebetween on adjacent bags to form top end pre-seal areas on adjacent bags and thereby reduce the material thickness of the pair of flexible plastic strips 14, 15 and the facing sidewalls 12, 13 of the bag sandwiched therebetween at the pre-seal areas. An example of the pre-sealed areas P is shown on the adjacent ends of the bags in FIG. 5. A pair of the end termination or clamping straps 30 is positioned over the pre-seal areas P, P, FIG. 5 and then the clamping straps 30 are wrapped over the top edges of the pair of strips 14, 15 at the pre-seal areas with the opposite ends of the clamping strap 30 engaging the opposite faces of the pre-seal areas P. During this wrapping operation the rivet 30*a* is inserted through the pre-seal areas P of the bag and through the opening 30*b* in the other end of the clamping strap 30. The opposite ends 30*d*, 30*e* of the clamping strap 30 are clamped and sealed to the opposite ends of the rivet 30*a* to produce a leakproof end termination on adjacent bags. This is shown in FIG. 1. Thereafter a side seal is formed across the thermoplastic sheets between bags and the bags are severed from each other at the pre-seal areas. The end clips 30 reinforce the zipper termination at the respective ends of the bag.

At the same time the end termination clips 30 are being assembled on the bags, it is also desirable to assemble the slider 10 with the profiled plastic reclosable fastener 11 of the thermoplastic bags. The foldable plastic slider 10 has been illustrated as of the type disclosed and claimed in the aforesaid copending related application Ser. No. 673,707.

Referring to FIG. 5 it will be seen that the foldable slider 10 with the wings 21 and 22 in open position is positioned above the strips 14 and 15. When the profile elements 16 and 17 are joined, the depending finger 9 is inserted between the top edges of the tracks 18 and 19. The depending legs 20*a* and 20*b* are positioned on the outer sides of the strips 14 and 15 and the body 20 of the slider 10 and rests on the top of the tracks 18 and 19. The wings 21 and 22 are then folded down at the hinge structure 21*a* and 21*b* located at the top of the slider body 20 so that the wings 21 and 22 are in their folded sidewall position against the edges of the slider body 20. When the side walls 21 and 22 are moved to the folded position as shown in FIG. 6, the compression-type latching mechanism comprising the flexible tongue 22*b* will have been compressed and snapped into locked position with the corresponding shoulder 20*d*, FIG. 5. A similar tongue and shoulder, not shown, are provided on the wing 21. Thus when the compression-type latching mechanism is locked into position as shown in FIG. 6 the sidewalls 21 and 22 are prevented from being rotated upwardly around the hinge structure 21*a* and 22*a*. In this assembled position, the shoulders 21*c* and 22*c* on the sidewalls 21 and 22 are positioned beneath the bottom of the fastener elements 16 and 17 to prevent the slider 10 from being lifted off the zipper 11.

The foldable depending sidewalls 21 and 22 extend from an opening end 10*a* of the slider 10 to a closing end 10*b*. It will be noted that the main slider body 20 and the separator finger 9 are wider at the opening end 10*a* then at the closing end 10*b*. Similarly the sidewalls 21 and 22 and the depending legs 20*a* and 20*b* are spaced wider apart at the opening end 10*a* of the slider 10 to permit separation of the rib and groove elements 16 and 17 by the finger 9 engaging the tracks 18 and 19 and are spaced sufficiently close together at the closing end 10*b* of the slider to press the rib and groove elements 16 and 17 into interlocking relationship as the slider 10 is moved in a fastener closing direction.

As may be seen in FIGS. 5 and 6 the wider end of the separator finger 9 includes a circular portion 9*a*. The separator finger also includes a narrower end comprising a straight sided portion 9*b* intersecting with the circular portion 9*a*. The wider end of the separator finger 9 includes a protrusion which is formed by spaced surfaces or shoulders 9*c* and 9*d* on the cylindrical portion 9*a* adjacent the intersecting straight sided portion 9*b* at the narrower end of the finger 9. The protrusion structure 9*c*, 9*d* comprises one portion of the means for restraining the slider 10 in closed position and maintaining the male and female elements 16 and 17 in interlocking relation when the slider 10 reaches the closed end of its travel along the tracks 18 and 19. The other portion of the restraining means comprises notch structure 18*a* and 19*a* at the adjacent end of the tracks 18 and 19 respectively. The notch structure 18*a* and 19*a* each have an end 18*b* and 19*b* located on the respective tracks 18 and 19 to permit the wider end 9*a* of the separator finger 9 to move beyond the notch ends 18*b*, 19*b* from between the tracks 18, 19 and into the notch structure 18*a*, 19*a*. The protrusion surfaces 9*c*, 9*d* are engageable respectively with the ends 18*b*, 19*b* of the notch structure 18*a*, 19*a* when the slider 10 is at the closed end of its travel on the tracks 18, 19. This restrains the wider end 9*a* of the separator finger 9 from moving out of the notch structure 18*a*, 19*a* and between the tracks 18, 19 and inadvertently opening the male and female elements 16 and 17 of the fastener or zipper 11. When the wider portion 9*a* of the separator finger 9 moves into the notch structure 18*a*, 19*a* and out from between the solid portions of the track 18, 19 this permits the solid portions of the track 18, 19 to be squeezed together along with the interlocking rib and groove elements 16 and 17 by the side walls of the slider 10. When the wider portion 9*a* of the finger 9 is in the notch structure 18*a*, 19*a*, the wider portion 9*a* of the finger 9 is ineffective to force the tracks 18, 19 apart which in turn would cause the rib and groove elements 16 and 17 to be pulled apart thus opening the zipper. Thus it will be seen that when the slider 10 is at the left hand end of the zipper 11, FIG.

6, the zipper 11 will be closed or sealed throughout its length thus providing a leakproof closure for the bag B.

The notches 18*a* and 19*a* in tracks 18 and 19 provide a leak-free parking spot for the separator finger 9 of the slider 10 adjacent the end termination clip 30 on the closed end of the bag, FIGS. 5 and 6. The slider 10 will be restrained in this leak-free parking spot by reason of the shoulders 9*c*, 9*d* on the enlarged end 9*a* on the separator finger 9 engaging the cooperating ends 18*b*, 19*b* on the notch structure 18*a*, 19*a* of the zipper 11. When the slider 10 is grasped and pulled to the right to a position as shown in FIG. 6 the restraining action provided by the finger and notches is overcome thereby causing the wider end 9*a* of the finger 9 to force apart the solid edges of the track 18 and 19 which in turn cause the interlocking rib and groove element 16 and 17 of the zipper 11 to move apart as the slider 10 is moved from the closed or left hand end of the zipper 11 toward the right hand end. The foregoing restraining action takes effect only when the slider 10 reaches the closed end of its travel at the left hand end of the zipper 11. This gives the user of the bag B a feel of a secure closure and assurance that the bag is closed with certainty. This is an important requirement with leakproof bags.

Figure 7:
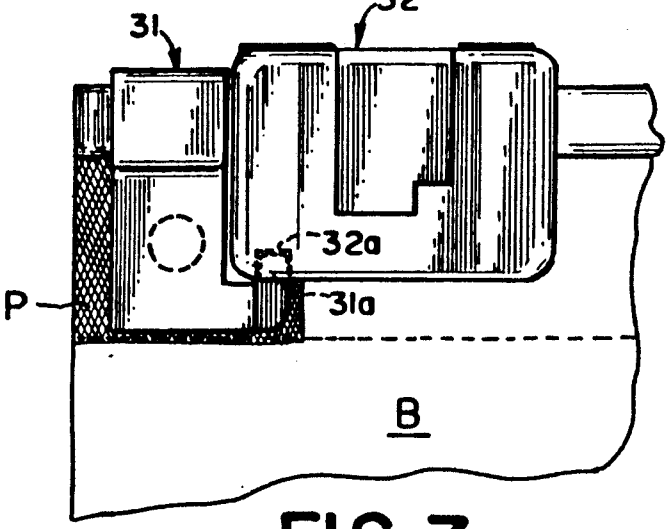
FIG. 7 is an elevational view showing a modification of the end clamp and slider.

Referring to FIG. 7 there is illustrated another embodiment of the invention. In this embodiment the end clamp 31 has a different configuration from the end clamp 30. The end clamp 31 includes a hook portion 31*a* which is adapted to extend into a cooperating recess 32*a* on the bottom of the wings of the slider 32. This detent structure comprising the hook member 31*a* and the cocperating recess 32*a* provide the user with a feel of a definite parking position for the slider 32 when the bag is closed. While only one hook member 31*a* has been illustrated in FIG. 5 it is to be understood that both sides of the end termination clamp 31 may be provided with such hooks and that the slider 32 may have both of its wings provided with recesses 32*a* to accommodate a pair of such hooks 31*a*. It is also to be understood that the slider 32 may be constructed similar to the slider 10 in other respects.

Figure 8:
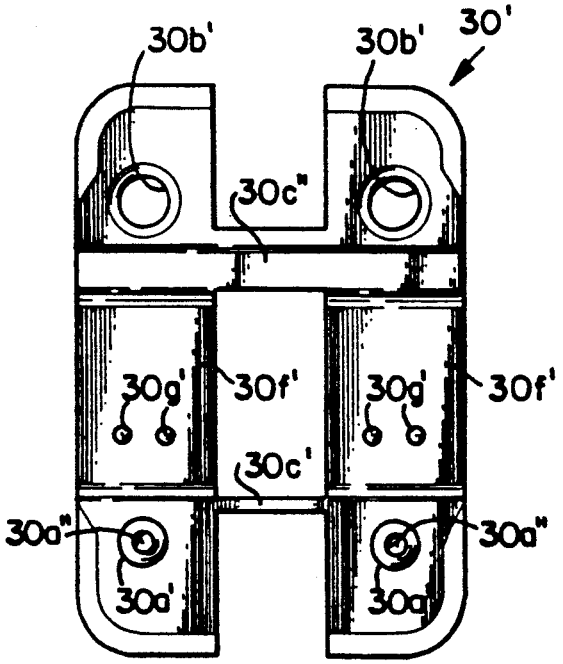
FIG. 8 is a plan view similar to FIG. 3 showing a modification of a pair of the end clamp stops.
Figure 9:
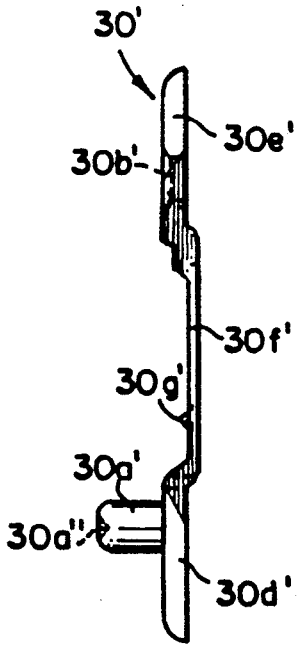
FIG. 9 is an end view of one of the end stops shown in FIG. 8.
Figure 10:
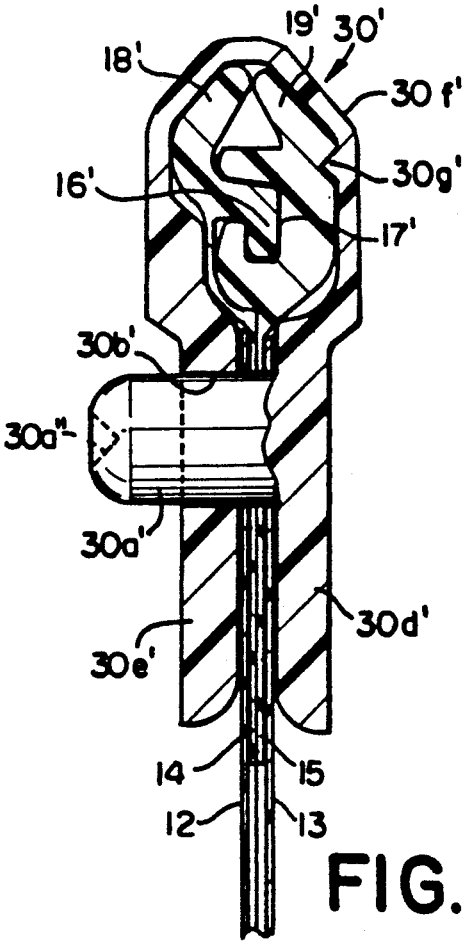
FIG. 10 is a sectional view showing the end clamp stop of FIGS. 8 and 9 assembled on the zipper preparatory to being locked in place.

Referring to FIGS. 8–10 there is illustrated a modification of the end clamps 30 shown in FIGS. 1–6. For ease of explanation corresponding parts of the end clamp stops 39 in FIGS. 8–10 have been provided with corresponding reference characters with the addition of a prime.

Referring to FIG. 8 it will be seen that the end clamp members 30' are preferably molded in pairs with one of the end clamps 30' being adapted to be attached to the left hand end of a bag and the other end clamp 30' of the pair being adapted to be attached to the right hand end of an adjacent bag in manner similar to that shown in FIG. 1. The end clamps 30' are maintained in pairs during the manufacture of the bags by reason of the thin interconnecting strips 30*c'* and 30*c'* which maintain the stops 30' in predetermined spaced relation. As may be seen in FIGS. 8 and 9 each of the end clamps 30' includes a pad 30*d'* from which the rivet like member 30*a'* extends and a similar pad 30*e'* through which the opening 30*b'* extends. The diameter of the rivet 30*a'* and the diameter of the hole 30*b'* are the same so as to provide a press fit when the rivet 30*a'* is inserted through the opening 30*b'*. Unlike the rivet 30*a* of FIG. 4 the rivet 30*a'* has a rounded end with a counter sunk opening 30*a''* in the end thereof. This is best seen in FIGS. 9 and 10. When the pin 30*a'* is pressed into the cooperating opening 30*b'* it acts as a punch and punches out a circular piece of the bag and fin material 12–15 as it passes therethrough into the opening 30*b'*. This is best seen in FIG. 10. The end of the rivet 30*a'* is then flattened and a head is formed thereon by pressure, heat or ultrasonic melting to form a head locked into the opening 30*b'*. Such a head would be similar to that shown on rivet 30*a* in FIG. 2. The pads 30*d'* and 30*e'* are interconnected by a relatively thin flexible strap section 30*f'*. The pads 30*d'* and 30*e'* which are held together by the rivet 30*a'* act as a pair of clamps on the opposite sides of the zipper 11 with the flexible strap portion 30*f'* wrapped over the top of the zipper 11 as shown in FIG. 10. The flexible strap portion 30*f'* has been illustrated in FIGS. 8 and 9 with pointed projections 30*g'* which are adapted to engage the top of the zipper 11 and aid in maintaining the end termination clamps 30'in position on the zipper 11. It will be noted in FIGS. 8–10 that the pad or clamp member 30*e'* is longer in the longitudinal direction than the cooperating clamp member 30*d'*. The purpose of this is to accommodate the irregular shape of the elements 16', 17', 18' and 19' of the zipper 11 when the clamps 30' are in sealed relation at the ends of the bag. It will be also be noted in FIG. 9 that the strap 30*f'* is offset from the pads 30*d'* and 30*e'* for this same purpose. By providing the rivet 30*a'* with a flat end rather than a pointed end as in the rivet 30*a* of FIG. 4, it has been found that it is easier to form a head on the end of the rivet and that the point is not necessary in order to enable the rivet to penetrate through the layers 12–15 of the bag and fin material to enter the cooperating opening 30*b'* in the clamp 30*e'*.

While a preferred embodiment of the invention has been described and illustrated, it is to be understood that further modifications thereof may be made within the scope of the appended claims without departing from the spirit of the invention.

What is claimed is:

1. In the manufacture of thermoplastic bags and the like having a reclosable fastener extending along the mouth of the bag and a slider straddling the fastener for opening or closing the fastener, the fastener comprising a pair of flexible plastic strip secured to the facing sidewalls of the bag and having reclosable interlocking male and female profile elements on the respective strips, the improvement comprising:

end clamp means located at the opposite ends of said reclosable fastener, each of said end clamp means comprising a pair of clamp members positioned on opposite sides of the bag for clamping the pair of strips and the facing sidewalls of the bag therebetween and holding the male and female profile elements in engaged position, and means for clamping each of said pair of clamp members together comprising a member extending through the ends of the pair of strips and the facing sidewalls of the bag and secured at the opposite ends thereof to said pair of clamp members to provide a seal at the ends of said reclosable fastener, said end clamp means being engageable with the slider for preventing the slider from moving past the ends of the reclosable fastener.

2. The improvement according to claim 1 wherein said pair of clamp members of each of said end clamp means are connected together by a flexible strap which extends over the top of the pair of strips and the facing sidewalls of the bag.

3. The improvement according to claim 1 wherein one end of the reclosable fastener forms the closed end thereof when the slider is at that end and said end clamp means located at the closed end of the reclosable fastener includes detent structure cooperable with structure on the slider when the slider is at the closed end for providing a resistance to movement of the slider during the initial opening of the reclosable fastener.

4. The improvement according to claim 3 wherein said detent structure comprises hook means on one of said clamps of said end clamp means for cooperating with recess structure on the slider.

* * * * *